US006116550A

United States Patent [19]

Forbes

[11] Patent Number: 6,116,550

[45] Date of Patent: Sep. 12, 2000

[54] SECURE HOLDER FOR HOUSEHOLD IRONS

[76] Inventor: Gary Douglas Forbes, 2782 Peel Rd., Springtown, Tex. 76082

[21] Appl. No.: 09/231,385

[22] Filed: Jan. 13, 1999

[51] Int. Cl.[7] ..... D06F 79/02

[52] U.S. Cl. ..... 248/117.2; 248/117.1

[58] Field of Search ..... 248/117.1, 117.2, 248/117.4, 117.5, 117.6, 117.7, 126, 52, 57; D32/73; 38/142

[56] References Cited

U.S. PATENT DOCUMENTS

| | | | |
|---|---|---|---|
| 1,759,214 | 5/1930 | Winters | 248/117.1 |
| 2,528,846 | 11/1950 | Sitnick et al. | 248/117.4 |
| 2,530,027 | 11/1950 | Perrigo | 248/117.1 |
| 2,584,011 | 1/1952 | Greenberg | 248/117.3 |
| 3,062,492 | 11/1962 | Hedger | 248/117.1 |
| 3,215,379 | 11/1965 | Rico | 248/117.2 |

*Primary Examiner*—Anita M. King
*Assistant Examiner*—Gwendolyn Baxter
*Attorney, Agent, or Firm*—Jerry C. Ray

[57] ABSTRACT

A wall-mounted holder for electrical household irons has a base plate with an insulating layer on a wall side of the holder to prevent heat transfer to the wall. Extending from the lower end of the base plate is an elongate tab, curved upward to form a cord support. The base plate includes two bosses on its lower portion which contact the hot sole plate of an iron. A support post extending upward from a support post mount engages an orifice in the sole plate of an iron to support the iron's weight. The support post and bosses provide three points of contact to minimize heat transfer from iron to holder.

4 Claims, 2 Drawing Sheets

Fig. 3
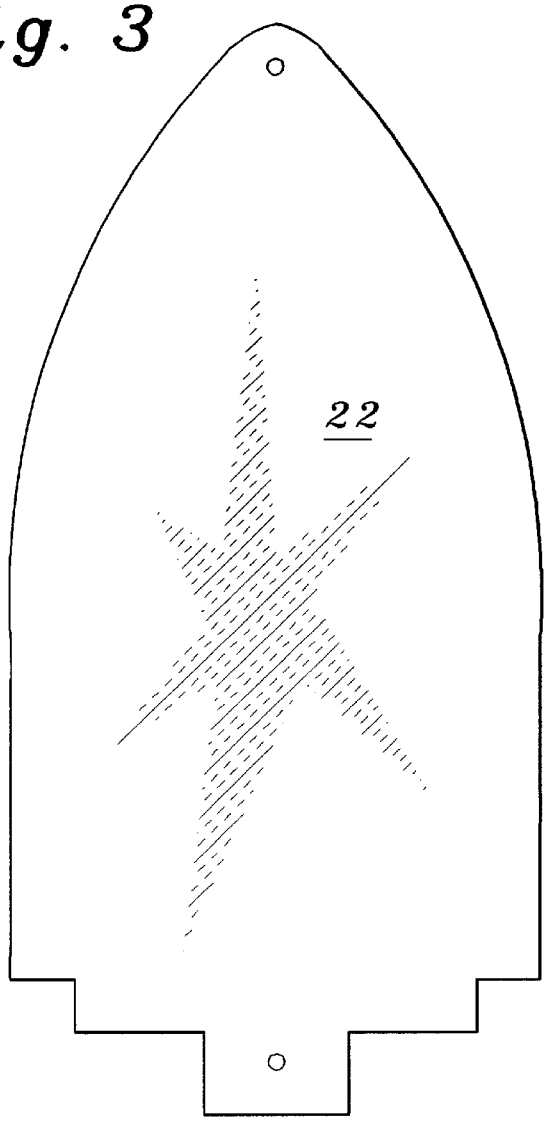
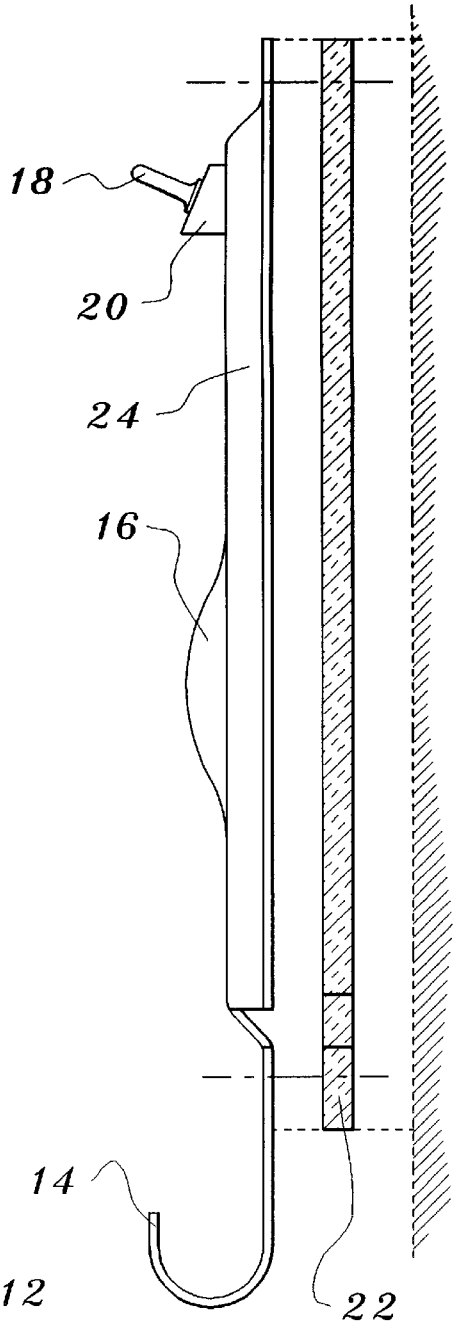
Fig. 4
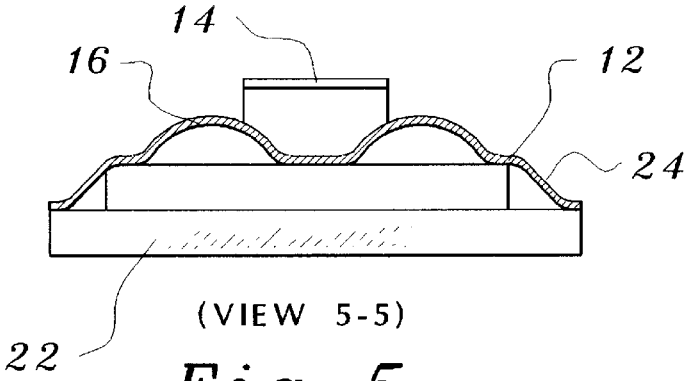
(VIEW 5-5)
Fig. 5

SECURE HOLDER FOR HOUSEHOLD IRONS

CROSS REFERENCE TO RELATED APPLICATIONS

Not applicable.

BACKGROUND OF THE INVENTION

1. Field of the Invention

This invention relates to holders for household irons, and particularly to such holders which may be mounted on a vertical wall and which include a support post for engaging an orifice in the iron's sole plate.

2. Description of the Related Art

Household irons are required to have a certain degree of weight due to their function of pressing wrinkles out of fabric. Also, of course, irons are electrically heated to enhance the wrinkle-removal process. The temperature of an iron's sole plate is high enough to cause severe burns, especially given the large surface area which can contact a person's skin. Both an iron's weight and its high temperature can render it dangerous to anyone who comes in contact with it or who inadvertently causes it to fall.

These dangers have been the impetus for the design and patenting of several devices for holding an electric iron. All the iron holders previously patented, however, rely on some sort of shaped bracket to engage and hold the iron in place. Examples of the prior art include Dry (U.S. Pat. No. 2,879,021), which discloses a bracket to engage the base of the iron, and shaped flanges to retain the point of the iron in the holder. Adams (U.S. Pat. No. 2,603,438) discloses an iron holder of shaped wire in which the iron is held point-downward. Burnish et al. (U.S. Pat. No. 2,529,132) and McCan (U.S. Pat. No. 2,448,227) both show a base having flanges to engage and hold an iron in a point-downward position.

SUMMARY OF THE INVENTION

The purpose of this invention is to provide an apparatus which will safely and securely hold a household iron, whether hot or cold, when not in use. The invention includes a metallic base plate which is mounted on a wall. Screw holes are provided in the base to facilitate mounting the holder in a convenient, out-of-the-way location. A layer of insulation separates the base from the wall, protecting the wall from residual heat in the iron. Contact with the wall is made by a flange or skirt extending from the edge of the base plate; the skirt provides separation between base plate and wall, contacting and protecting the edge of the insulation layer. Two bosses protrude from the lower portion of the base plate; the bosses provide isolated contact points for an iron's hot sole plate and further reduce conductive heat transfer from the iron.

Positive support for an iron is provided by a support post which extends at an upward angle from a mount on the base plate. A matching orifice in the iron's sole plate is engaged by the post; the angle of the post guides the iron downward, into contact with the base plate. When an iron is placed on holder, the person holding the iron can readily tell determine whether the iron is engaged by the support post. Once the orifice in the iron's sole plate engages the support post, the angle of the post and the weight of the iron cause the iron to settle onto the post in firm engagement.

The holder, as briefly described above, provides a readily-accessible, secure place to store a hot iron. With an iron on the holder, engaging the support post, an upward lift is required to remove the iron from the holder. In addition, the iron's cord is stored out of reach on a curved support, formed from a tab extending from the lower part of the base plate. Other advantages of the secure iron holder include its ability to hold an iron while the iron is hot; this allows storage of a still-hot iron after use, and also allows safe pre-heating of the iron prior to its use.

Based on the above, it is an object of this invention to provide a secure wall-mounted holder in which a household iron may be safely stored.

It is another object of this invention to reduce the number of accidental burns and other injuries caused by household irons.

A further object of this invention is to provide a device for safely and easily storing an iron, whether hot or cold.

Further objects are to achieve the above with devices that are compact, durable, simple, efficient, and reliable, yet inexpensive and easy to install.

The specific nature of the invention, as well as other objects, uses, and advantages thereof, will clearly appear from the following description and from the accompanying drawings, the different views of which are not necessarily scale drawings.

BRIEF DESCRIPTION OF THE DRAWINGS

FIG. 3 is a rear elevation, showing an insulation pad on the wall side of the iron holder.

FIG. 4 is a side elevation of the iron holder showing an insulation pad on the wall side.

FIG. 5 is a cross section on view 5—5 of FIG. 1.

CATALOG OF THE ELEMENTS

Figure 1:
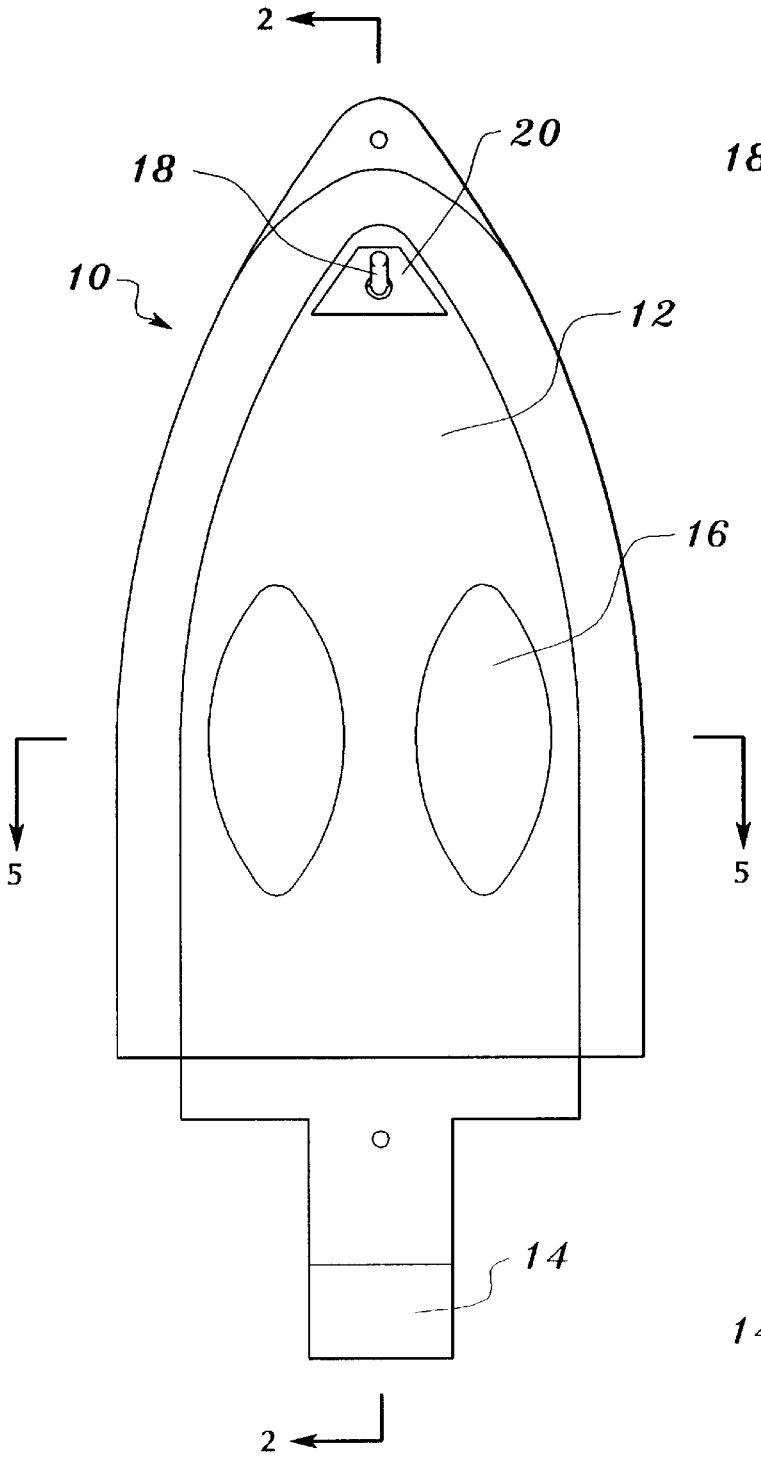
FIG. 1 is a front elevation of the iron holder.

To aid in the correlation of the elements of the invention to the exemplary drawings, the following catalog of the elements is provided:

10 iron holder
12 base
14 cord support
16 support boss
18 support post
20 support post mount
22 insulating pad
24 skirt

DESCRIPTION OF THE PREFERRED EMBODIMENTS

Referring now to the drawings, FIG. 1 is a frontal elevation of the iron holder 10. The iron holder 10 is sometimes referred to herein as a "bracket." A base 12 provides structural support for other components of the holder 10. Base 12 is dimensioned so that it is somewhat wider and longer than an ordinary household iron. A general location of mounting holes for base plate 12 are shown in FIG. 1 and FIG. 3.

Extending downward (i.e., with the holder mounted vertically) from the main body of the holder, an elongate tab formed by an extension of the base 12 is curved upward to form cord support 14. A loose, dangling cord which might be pulled on by a young child is hazardous; by providing a convenient place to store a cord, the cord support 14 eliminates this particular danger.

Figure 2:
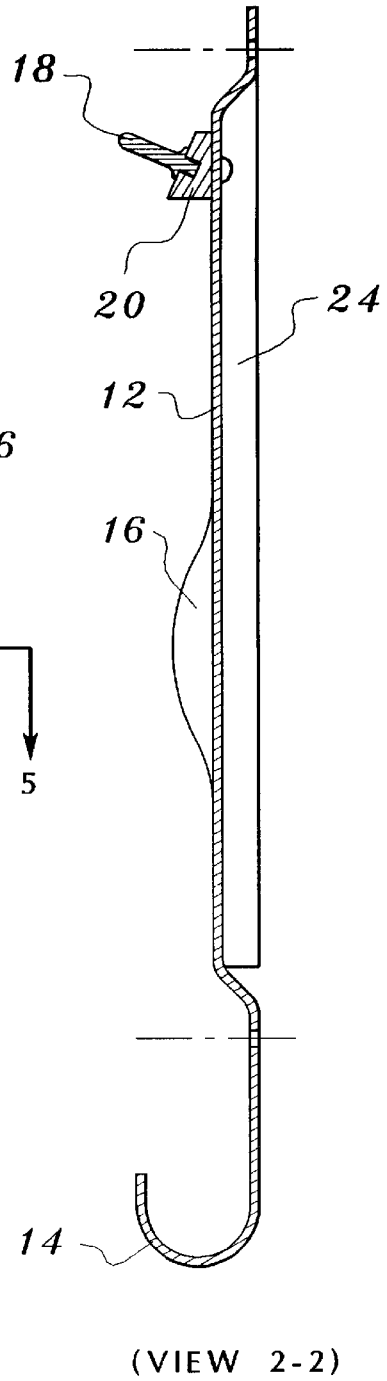
FIG. 2 is a cross section on view 2—2 of FIG. 1.

Separating the hot sole plate of the iron from the base are three contact points. An iron in place in the holder contacts the base plate only at these three points: one is the support post mount 20, described below; the other two are bosses 16. A boss, as used herein, is defined as "a protuberant part or body." Bosses 16 are protuberances on the base plate, as shown in FIGS. 2 and 5. The three-point contact holds the iron away from the base plate and reduces conduction of heat from a hot iron to the base plate. Bosses 16 also provide additional, raised surface area on the base plate from which heat is radiated away, further reducing heat transfer when the stored iron is hot.

As shown in FIG. 5, the perimeter of base plate 12 is shaped into a wall-engaging flange or skirt 24, which is at an angle relative to the plane of base plate 12. Skirt 24 contacts the wall, keeping the larger area of base plate 12 separated from the wall. In addition, skirt 24 defines an area within which an insulating pad 22 may be installed as described below; an interior surface of the skirt contacts an outer edge of insulating pad 22.

Transfer of heat from the iron holder 10 to the wall on which it is mounted is further slowed by insulating pad 22, shown in FIG. 3. As shown in FIG. 4, the insulating pad 22 is relatively thin, only 0.025" to 0.25"; nevertheless, the effectiveness of the insulation prevents damage to the wall's finish due to heat from the iron or its holder.

As shown in FIG. 2, support post 18 is threaded on its lower extremity; the threaded end engages female threads in support post mount 20. A flange at the base of support post 18 provides a stop when post 18 is screwed into mount 20. The perimeter of the flange is hexagonal, providing purchase for a wrench; the flat sides of the hexagonal flange facilitate tightening the post into its mount. Support post 18 is disposed at an upward angle to base plate 12. An angle of about 22° above horizontal is effective at holding an iron in place while allowing the iron to be easily placed on and removed from the support post. That is, the 22° angle is sufficiently steep so that the iron cannot accidentally disengage from the support post, while not so steep as to interfere with removal of the iron by requiring that the iron be lifted at a sharp upward angle to disengage it from the post.

Support post mount 20, as shown in FIGS. 2 and 4, is made from steel, aluminum, or other suitable material. An outer face of the support post mount is angled as shown in FIG. 2, so that when the support post is screwed into it, the post is held at an angle as described above. Support post mount 20 is attached to the holder base by two or more screws, which are inserted through the base plate and into threaded orifices in mount 20. Alternatively, the support post mount is attached by welding or by other means. Support post 18 engages a matching orifice in the sole plate of an iron, providing the primary support for the weight of the iron.

The restrictive description and drawings of the specific examples above do not point out what an infringement of this patent would be, but are to enable one skilled in the art to make and use the invention. Various modifications can be made in the construction, material, arrangement, and operation, and still be within the scope of my invention. The limits of the invention and the bounds of the patent protection are measured by and defined in the following claims.

I claim as my invention:

1. A secure holder for a household iron, comprising:

a base plate including means for attachment to a vertical surface, at least one boss on said base plate adapted to contact a sole plate of said iron, adapted to separate said iron from said base plate, a support post mount attached to an upper portion of said base plate, and a support post adapted to engage an orifice in an iron's sole plate, said support post attached to and extending upwardly from said support post mount.

2. A secure holder for a household iron as described in claim 1, further comprising:

an insulating layer attached to a wall side of said base plate to provide a thermal barrier between said base plate and a wall on which said base plate is mounted.

3. A secure holder for a household iron as described in claim 1, further comprising:

a wall-engaging skirt extending from a perimeter of said base plate to provide separation between said base plate and a wall on which said base plate is mounted.

4. A secure holder for a household iron as described in claim 1, wherein said support post extends upwardly at an angle of about 22° from horizontal.

* * * * *